United States Patent [19]

Capolongo

[11] 3,988,559

[45] Oct. 26, 1976

[54] MOBILE INDUCTORS FOR INDUCTION HEATING SYSTEMS

[75] Inventor: Pasquale Capolongo, Woodside, Queens, N.Y.

[73] Assignee: Lepel High Frequency Laboratories, Inc., New York, N.Y.

[22] Filed: Apr. 24, 1975

[21] Appl. No.: 571,086

[52] U.S. Cl. ..... 219/10.43; 198/656; 219/10.69; 198/803

[51] Int. Cl.[2] ..... H05B 5/02

[58] Field of Search ..... 219/10.41, 10.43, 10.67, 219/10.69, 10.75; 266/5 EI; 214/21; 432/124; 198/209

[56] References Cited

UNITED STATES PATENTS

| | | | |
|---|---|---|---|
| 2,470,311 | 5/1949 | Hoyler et al. | 219/10.69 U |
| 2,547,635 | 4/1951 | Freshwater et al. | 219/10.69 X |
| 2,647,199 | 7/1953 | Wharff, Jr. | 219/10.69 |
| 3,748,425 | 7/1973 | Potter | 219/10.69 |

*Primary Examiner*—Bruce A. Reynolds

[57] ABSTRACT

An apparatus for induction heating of electrically conductive workpieces which apparatus includes a carousel having equally spaced openings around its periphery for receiving individual of the workpieces, a primary induction coil mounted in fixed position in an induction heating zone adjacent the periphery of the carousel and a secondary induction drum having a first opening for rotation through the coil, a second opening for receiving the end of a workpiece held in said carousel and a slot interconnecting the first and second drum openings.

8 Claims, 4 Drawing Figures

MOBILE INDUCTORS FOR INDUCTION HEATING SYSTEMS

This invention relates to induction heating of workpieces and, more particularly, to the rapid and selective induction heating of such workpieces in production sequence one after the other.

Induction heating is a well-known phenomenon by which an article of electrically conductive material, herein referred to as a workpiece, may be heated when exposed to a rapidly varying magnetic field. Such field might be developed by a single or multi-turn coil, usually of copper, surrounding the workpiece or the portion thereof to be heated. The coil, herein referred to as the primary inductor, is energized with an alternating current. Depending upon the alternating current frequency, the power level, the resistivity, the thermal conductivity and other factors, the workpiece can be heated selectively and rapidly. The alternating current fields, flowing from the primary inductor, induces a shallow peripheral current in the workpiece. Such peripheral current in the workpiece is commonly referred to as a skin effect.

Wide applications have, heretofore, been found for the skin effect of induction heating. Such applications have included skin or case-hardening of steel shafts, sprockets, cams and the like. Shallow, case-hardening of such items provides hard wearing surfaces without adversely effecting the toughness of the substrate.

Shallow, case-hardening by induction heating permits differential heat treatment or hardening of the skin and the core of a workpiece. The core of a workpiece may be hardened and tempered to a desired hardness level to provide high strength with low brittleness. Such desired hardness level may be attained in conventional manner with conventional heat treatment processes. Once desired core hardness and temper has been attained, such workpiece might then be induction heat treated so as to superimpose over the previously hardened and tempered core a skin or case of higher hardness. Such differential hardness can be accomplished through induction heating with minimal disturbance to the core region. Workpieces, such as chain saw rivets and self-tapping screws, are examples where differential hardness is desirable.

While the many advantages and results to be attained through the use of induction heating have long been recognized, the use of such heating, where high quantities of workpieces are to be treated in a localized area for a limited length of time, has been limited. Such limited use has, for the most part, been because of the inability to provide precise, uniform and repeatable heat cycles to workpiece, as such workpieces are treated, and difficulties in feeding the workpieces, one after the other, into and out of the induction heat zone. Difficulties in precisely timing the treatment to avoid under treatment or over treatment has also limited use of induction treatment.

In the instant invention, many of the difficulties heretofore encountered in induction heat treating of high quality workpieces are eliminated. Through the invention, the workpieces are fed, one after another, into an induction heating area and, while in such area, are induction heated. The feeding and positioning of each workpiece in the heating area is precisely controlled, as is the induction heating of the workpiece while in the area. The on-set and removal of application of the induction field and, through the field, the induction heating to the workpiece is also precisely controlled. The feeding, positioning, heating and removal of the workpieces is carried on continuously so that, through the instant invention, high frequency induction heating of workpieces, such as, set-screws, pins and relative small articles of electrically conductive material, is practical.

The workpieces to be processed are fed, one after the other, to a disc or carousel provided, around its periphery, with equally spaced receptacles. As the disc or carousel passes the workpiece feed, one workpiece is fed into each receptacle. Thus, as the receptacles are rotated away from the feed, each receptacle contains a workpiece. The workpieces, one after the other, are carried, by the carousel, from the feed to, and through, the high frequency induction heater and, from the heater, to a station where the induction heat treated workpieces are discharged from the carousel. Guides align the workpieces in the carousel.

A high frequency inducting field is applied to the workpieces in the instant invention, as they are being fed by the carousel, by a mobile inductor. The mobile inductor, of which there are a plurality equally spaced around a drum, is rotated through a primary inductor. Preferably, the primary inductor is a U-shaped induction coil and the inductor drum, with the equally spaced mobile inductors therein, is rotated through the legs of the inductor coil.

Each of the mobile, or secondary inductors includes a work end and an induction end, the two ends being joined by a narrow slot. The work end of the secondary inductor is shaped in a configuration to accommodate the workpiece to be treated and to allow for insertion and withdrawal of the workpiece from the work end. The induction end of the secondary inductor is shaped so that, in combination with the shape of the primary inductor or induction coil, the on-set, removal and application of the induction field and induction heating to the workpiece is precisely controlled.

Timing of application of the induction field and induction heating in the instant invention is dependent upon the motion and speed of the carousel and inductor drum. Fluctations arising from the initiation of power pulses, through the use of relays, times, and the like, are avoided. Because, in most cases, the primary inductor or coil can be energized continuously, wear and tear to the power supply from interrupted power flow is avoided.

The instant invention will be more clearly understood from the following description taken with the drawings of the preferred embodiment of the invention in which.

Figure 1:
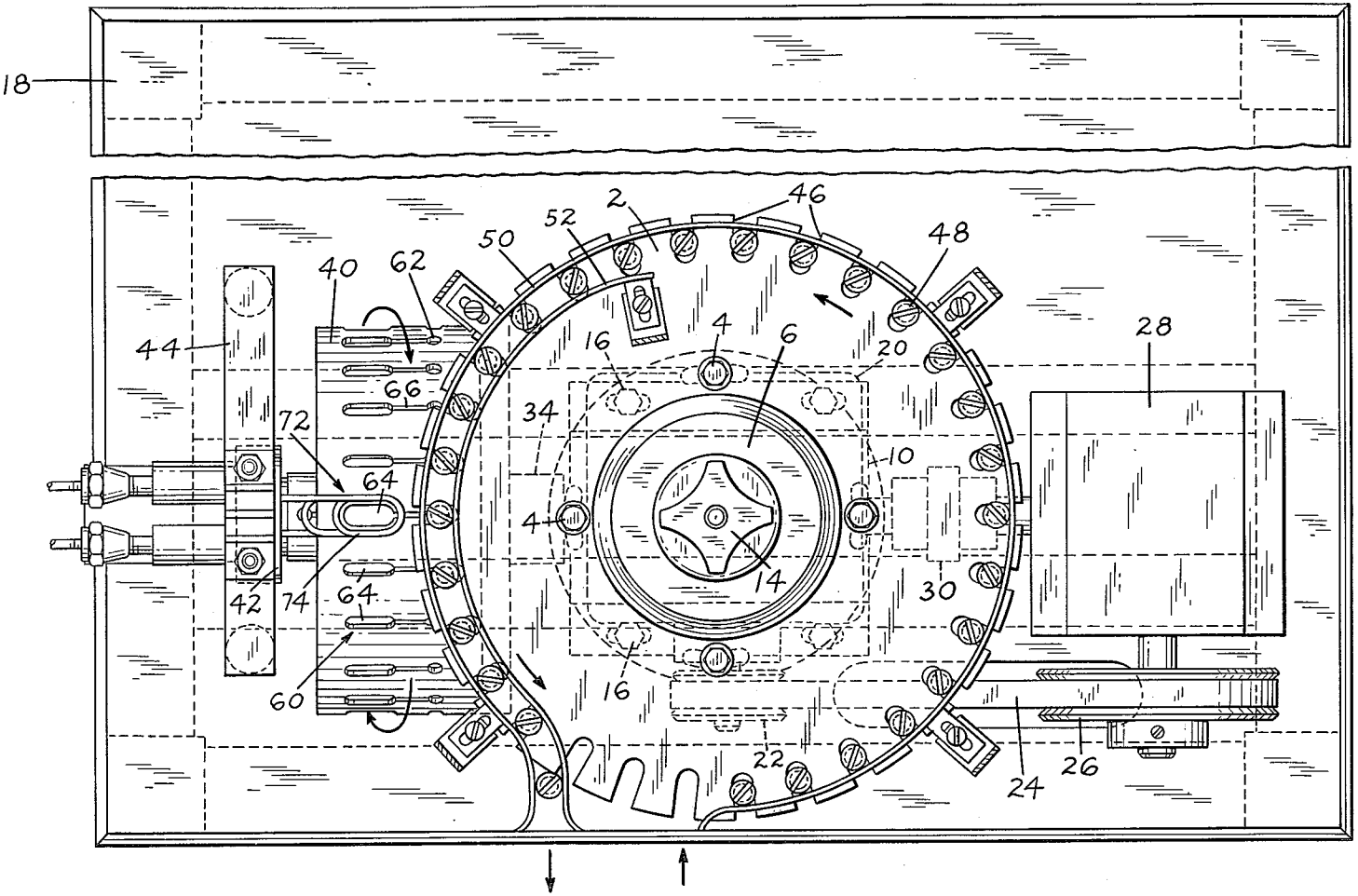
FIG. 1 is a top plan view of an apparatus of the invention.

Referring to the drawings, carousel 2 is adjustably mounted, by bolts 4, on hub 6, which, in turn, is mounted for vertical adjustment on shaft 8 of gear box 10 by spline 12 and adjusting screw 14. Gear box 10 is adjustably mounted, by bolts 16, on base 18. For reasons more apparent hereinafter, carousel 2 is circumferentially adjustable, relative to hub 6, by bolts 4, vertically adjustable relative to hub 6 by adjusting screw 14 and horizontally adjustable, along with shaft 8 and gear box 10 by bolts 16.

Motor 20, through pulley 22, belt 24 and pulley 26 is connected to gear box 28 which, through coupling 30, is connected to gear box 10. Shaft 32 of gear box 10 is splined to one end of drum hub 34 connected, by bolts 36, to flange 38 of drum 40. Drum hub 34 is supported by bearing 42 mounted in pedestal 44 fixed to base 18. Motor 20, through coupling 30 and gear box 10, turns carousel 2 and drum 40 so that, during each revolution of carousel 2 there is an equal revolution of drum 40.

Figure 2:
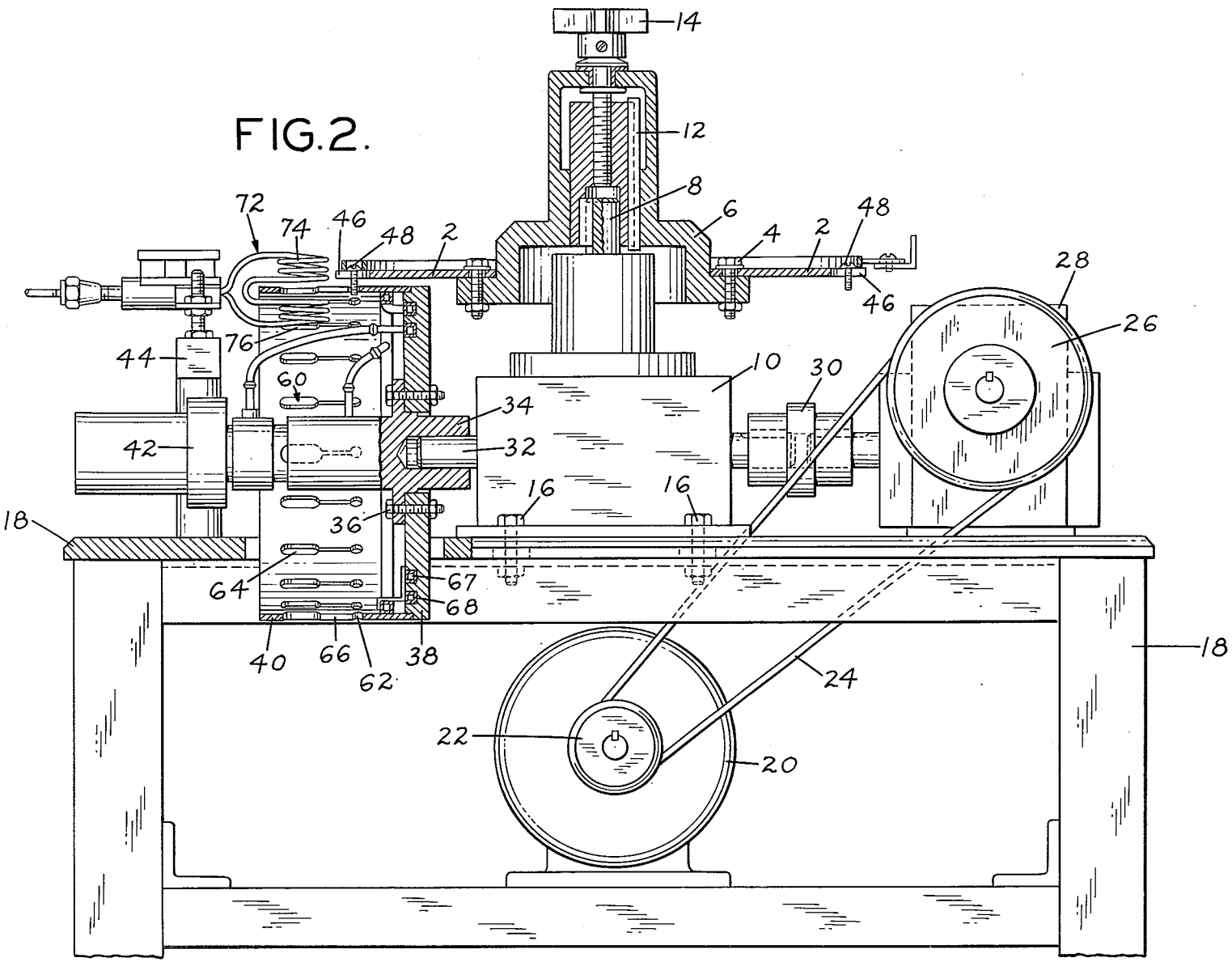
FIG. 2 is a side elevational view, partly in section, of the apparatus of FIG. 1.
Figure 4:
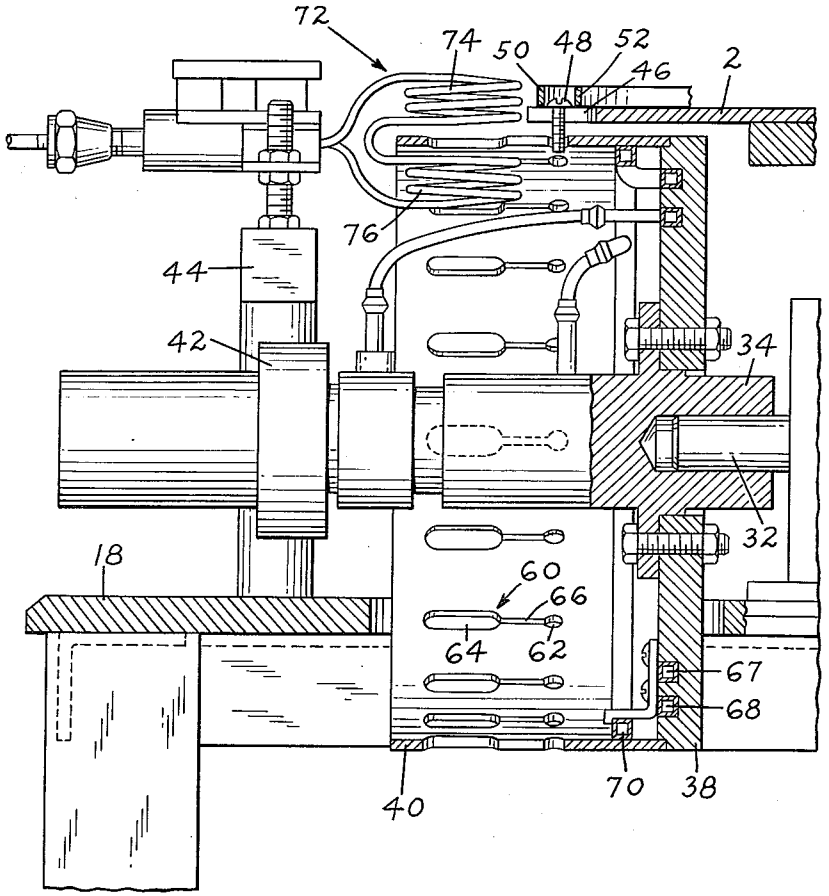
FIG. 4 is a side elevational view, partly in section, of the portion of the apparatus of FIG. 3.
Figure 3:
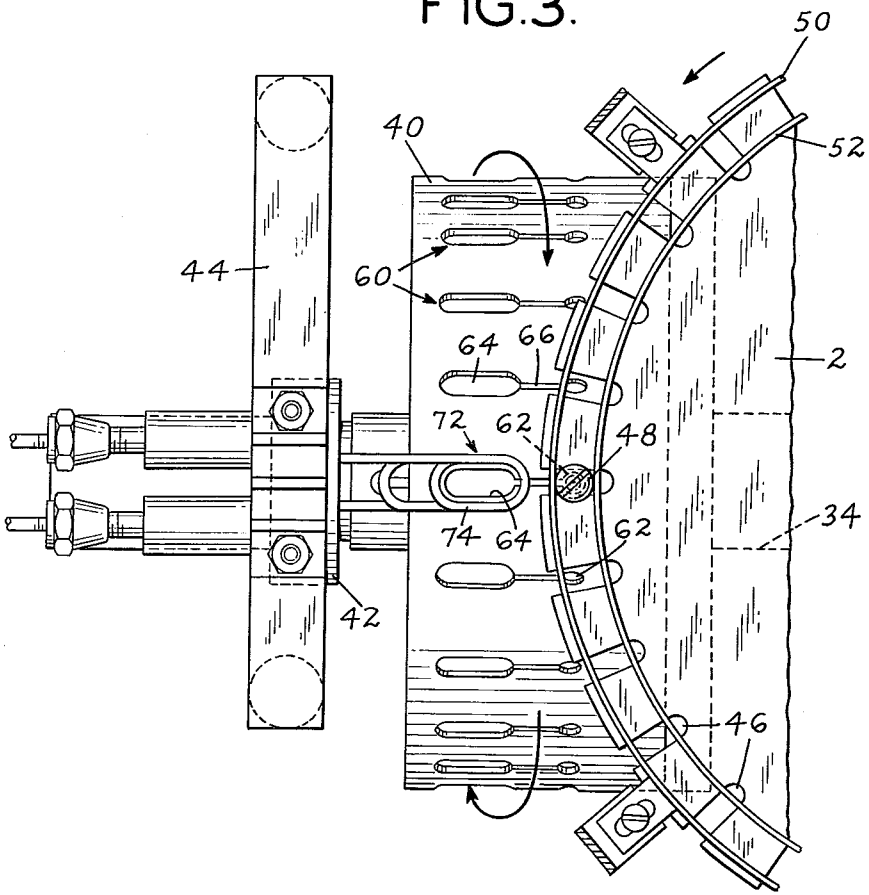
FIG. 3 is an enlarged top plan view of a portion of the apparatus of FIG. 1, showing certain of the components in enlarged detail.

As is best shown in FIG. 1 and 3, around its periphery and spaced at equal intervals there around carousel 2 is provided with receptacles or slots 46, the slots extending through the carousel and being of a width to receive a workpiece for treatment and for supporting such workpiece, for example, screw 48, therein. Guides 50, 52 are mounted in fixed position above carousel 2 so as to guide and center the workpiece in slot 46 as carousel 2 is rotated and the workpieces pass between the guides. At equal intervals therearound, drum 40 is provided with a plurality of openings, generally designated 60. Each opening 60 includes a circular workpiece receiving opening 62, an elongated inductor opening 64 and a narrow slot 66 connecting openings 62, 64. As best shown in FIGS. 2 and 4, drum hub 34 and drum 40 are cooled by a coolant, such as water, circulated through conduits 66, 67, 70.

Induction coil, generally designated 72, having an upper coil portion 74 and a lower coil portion 76, is mounted in fixed position on pedestal 44 and base 18. As best shown in FIGS. 2 and 4, as drum 40 is rotated by motor 20 and gear box 10, elongated inductor openings 64 in drum 40 are rotated past fixed coil 72, drum 40 passing between upper coil portion 74 and lower coil portion 76.

As best shown in FIGS. 1 and 3, coil portions 74, 76 are elongated, the shape of the coil portions conforming substantially, to the shape of inductor opening 64 in drum 40. As drum 40 rotates between coil portions 74, 76 of U-shaped coil 72, the elongated sides of opening 64 pass over the parallel to the elongated sides of coil portions 74, 76. As will be later described, such parallel movement of the elongated sides of inductor openings 64 relative to the elongated sides of coil portions 74, 76 is of substantial importance.

In the operation of the apparatus of the present invention, carousel 2 and drum are driven by motor 20 in the directions of the arrows, FIGS. 1 and 3. By adjusting bolts 4, 16, screw 14 and guides 50, 52, workpieces 48 in slots 46 in carousel 2 are positioned so as to be fed into workpiece receiving openings 62 in drum 40 as carousel 2 and drum 40 are driven by motor 20.

With carousel 2 and guides 50, 52 adjusted and with motor 20 driving carousel 2 and drum 40, workpieces 48 are fed and deposited, one after the other, in receptacle slots 46 in carousel 2. The workpieces are fed into the slots so that the portion of the workpiece to be treated extends downwardly below carousel 2 and a portion of the workpiece extends upwardly from the carousel for guide purposes for reasons more apparent hereinafter. In the illustrated embodiment, the workpiece is a screw. The head of the screw supports the workpiece in carousel 2 and engages guides 50, 52 for aligning the workpiece with workpiece receiving opening 62 in drum 40.

With workpieces 48 aligned in slots 46 and with carousel 2 turning in a counter-clockwise direction, as indicated by the arrows FIG. 1, the downwardly extending ends of workpieces 48, register with workpiece receiving openings 62 in drum 40 so that the workpiece end of each workpiece enters an opening 62 in drum 40 as the drum rotates toward carousel 2 in fixed rotational relationship therewith. The lowermost end of the workpiece enters the opening 62 well ahead of the registry of its inductor opening 64 with inductor coil 72. As rotation of carousel 2 and drum 40 continues and inductor opening 64 comes into registry with inductor coil 72, that portion of workpiece 48 to be induction heated is substantially centered in workpiece receiving opening 62.

Induction coil 72 is energized in conventional manner, not shown, while carousel 2 and drum 40 are rotating. As the inductor opening 64 in drum 40 approaches and registers with coil 72, a rapidly varying magnetic field is induced, by energized coil 72, in drum 40 which, preferably, is of copper or other material receptive to such an induced field. The rapidly varying magnetic field, induced by coil 72 in drum 40, induces a shallow peripheral current in the workpiece in opening 62, which, in turn, induces a rapid increase in temperature at the periphery and around the workpiece. Depending upon the frequency and power level of the applied current, speed of the carousel and drum or dwell time of the workpiece in the treatment zone, as well as other well known factors in induction heating, the workpiece may be suitable induction heat treated.

In the apparatus of the instant invention, carousel 2 and drum 40 rotate continuously at uniform speed. Thus, the workpiece is moved into, through and out of the induction heating station of coil 72 and opening 60 in a continuous movement path. Because of the shape of coil 72 and opening 60 and the inter-action of such shapes, as one is moved relative to the other, the on-set and removal of the induced magnetic field and resulting induced heating of the workpiece is rapid. Thus, heat treatment of the workpiece can be controlled and limited to a localized area. Over heating and undesirable heating in areas adjoining the area being treated is substantially reduced. Each workpiece is individually heated in uniform manner with uniform results.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for feeding electrically conductive workpieces, one after another, through an induction heating zone and for induction heating portions of said workpieces while in said zone said apparatus including workpiece feeding means having uniformly spaced openings for receiving individual of said workpieces, means for moving said feeding means and said workpieces therein through a pre-selected path and through an induction heating zone in said path, an induction coil mounted in fixed position in said induction heating zone and a drum mounted for rotation through said path, said zone and the induction field of said coil, said drum having a first opening in rotational alignment with said coil and a second opening interconnected with and spaced from said first opening for receiving the ends of said workpieces in said feeding means as said workpieces are moved through said preselected path and said drum is rotated through said path, said zone and said induction field of said coil.

2. Apparatus for feeding electrically conductive workpieces and for induction heating portions thereof, a recited in claim 1, in which said workpiece feeding means is a carousel and said uniformly spaced openings extend inwardly from the marginal edge of said carousel.

3. Apparatus for feeding electrically conductive workpieces and for induction heating portions thereof, as recited in claim 2, in which said carousel is mounted for rotation about a vertical axis and said workpieces are mounted in said inwardly extending openings with the portion of said workpiece to be induction heated extending downwardly from said carousel.

4. Apparatus for feeding electrically conductive workpieces and for induction heating portions thereof, as recited in claim 3, in which said drum is mounted for rotation about a horizontal axis beneath said carousel and said portion of said workpiece to be induction heated is received in said second drum opening as said carousel and said drum rotate and said drum rotates through said induction field of said coil.

5. Apparatus for feeding electrically conductive workpieces and for induction heating portions thereof, as recited in claim 4, in which said coil is elongated in a direction transverse to the direction of rotation of said drum and said first opening in said drum is elongated in a direction parallel to the elongation of said coil.

6. Apparatus for feeding electrically conductive workpieces and for induction heating portions thereof, as recited in claim 5, in which said induction coil includes an upper elongated coil portion and an interconnected lower elongated coil portion in alignment with said upper portion, said interconnected coil portions forming a U-shaped opening through which said drum and said first opening in said drum are rotated.

7. Apparatus for feeding electrically conductive workpieces and for induction heating portions thereof, as recited in claim 6, said drum having a plurality of said first openings and said interconnected second openings, said plurality of openings being equally spaced around said drum and along the path of rotation

8. Apparatus for feeding electrically conductive workpieces and for induction heating portions thereof, as recited in claim 7, including guide means above said carousel for engaging and guiding said workpieces in said inwardly extending openings.

* * * * *

UNITED STATES PATENT AND TRADEMARK OFFICE

CERTIFICATE OF CORRECTION

PATENT NO. : 3,988,559

DATED : October 26, 1976

INVENTOR(~~s~~) : Pasquale Capolongo

It is certified that error appears in the above-identified patent and that said Letters Patent are hereby corrected as shown below:

Column 3, line 44:

Cancel "the", first occurrence, and substitute -- and --

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*